US005114027A

United States Patent [19]

Mautino

[11] Patent Number: 5,114,027

[45] Date of Patent: May 19, 1992

[54] CAST BLOCKOUT APPARATUS FOR A DRAFT GEAR POCKET

[75] Inventor: Peter S. Mautino, Verona, Pa.

[73] Assignee: McConway & Torley Corporation, Pittsburgh, Pa.

[21] Appl. No.: 703,015

[22] Filed: May 20, 1991

[51] Int. Cl.[5] ..... B61G 7/10

[52] U.S. Cl. ..... 213/57; 213/50; 213/61

[58] Field of Search ..... 213/50, 51, 56, 57, 213/58, 60, 61, 62 R, 62 A, 63, 64, 66, 67 R, 69

[56] References Cited

U.S. PATENT DOCUMENTS

| | | | |
|---|---|---|---|
| 1,446,028 | 2/1923 | Barrows | 213/57 |
| 1,458,742 | 6/1923 | Barrows | 213/57 |
| 1,918,862 | 7/1933 | O'Connor | 213/50 |
| 3,700,854 | 10/1987 | Chadwick | 213/50 |
| 4,531,648 | 7/1985 | Paton | 213/50 |
| 4,555,033 | 11/1985 | Miller | 213/51 |
| 4,573,594 | 3/1986 | Kunst et al. | 213/51 |
| 4,580,686 | 4/1986 | Elliott | 213/62 |
| 4,700,853 | 10/1987 | Altherr et al. | 213/50 |
| 4,846,358 | 7/1989 | Rhen | 213/64 |

FOREIGN PATENT DOCUMENTS

| | | | |
|---|---|---|---|
| 2169569 | 7/1986 | United Kingdom | 213/62 R |

*Primary Examiner*—Robert J. Oberleitner
*Assistant Examiner*—Mark T. Le
*Attorney, Agent, or Firm*—James Ray & Associates

[57] ABSTRACT

A castable draft gear pocket blockout apparatus for use in retrofitting slackless drawbar coupler assemblies to existing railroad cars having draft gear pockets, the blockout apparatus being a cast metallic structure having a web, a top flange and a bottom flange connected along the upper and lower sides of the web, and the first and second end flanges connected to the first and second vertical sides of the web.

20 Claims, 4 Drawing Sheets

CAST BLOCKOUT APPARATUS FOR A DRAFT GEAR POCKET

FIELD OF THE INVENTION

The present invention relates, in general, to equipment used for coupling a pair of railway cars together and, more particularly, this invention relates to a new and improved cast blockout device for installation in a draft gear pocket; such blockout device having particular utility for use in retrofitting slackless drawbar coupler assemblies to existing railroad cars having draft gear pockets. The castable blockout device is relatively easy to manufacture at a relatively low cost; such blockout device having a relatively simple form which can be cast with conventional foundry techniques, and yet exhibiting more than a requisite amount of strength and rigidity for its intended application.

BACKGROUND OF THE INVENTION

As is generally well known, most prior art railroad coupler assemblies are relatively complicated. These coupler assemblies, in addition to rather complex coupler connections and associated components, normally include a draft gear or some other shock absorbing device which are provided to cooperate with the connection between the coupler components and the railroad car center sill to prevent damage to both lading and equipment.

The draft gear assemblies are positioned to receive the linear impact loads incidental to train movements and coupling activity. These draft gear assemblies function to absorb and dissipate the forces generated during such train movements. While draft gear assemblies originally consisted primarily of heavy compression springs, current day draft gear structures are of various types. Modern draft gear assemblies include friction draft gears, hydraulic draft gears, rubber draft gear, combination friction-rubber draft gear and others. All of these draft gears are designed to permit some form of compressive reaction in response to sudden buff or draft loading which will compress the draft gear to absorb and dissipate the impact energy. Accordingly, such conventional railway car coupler arrangements have a degree of both free and cushioned slack. That is, there is a certain amount free "play" between the coupler components and the center sill member when the load changes from a draft to a buff load, and vice versa.

More recently, however, research has indicated that the elimination of the free and cushioned slack within a train consist can result in the substantial elimination of over the road train forces due to "run-ins" and "run-outs". The magnitude of these train forces are normally quite large. Furthermore, these train forces can cause significant wear and tear on the rolling stock. In some instances, these forces may even be severe enough to be a contributing factor in bringing about a derailment of at least a portion of the train consist. Specifically, in conventional coupler assemblies, the draft key or pin connection of the coupler to the yoke is at a relatively long distance from the kingpin about which the car truck is free to rotate. The negotiation of curves, particularly under buff loading conditions, can give rise to relatively large lateral forces being generated. These large lateral forces can be particularly damaging to the coupling and draft gear equipment Also, as is well known in the railway art, a conventional draft gear assembly is provided with some form of compression member. Such compression member is positioned to reciprocate linearly and substantially parallel to the center sill to absorb and dissipate the linear forces. Accordingly, any lateral forces which may be created will often tend to twist or bend the moving elements thereby establishing conditions which can contribute to damage of the draft gear assembly.

As is likewise known, drawbar-type coupler assemblies are particularly adapted for use in unit train applications. In a unit train, the railway cars are normally coupled and uncoupled only for periodic maintenance and repair. Such cars usually are not subjected to routine impact forces associated with bumping encountered in classification yards and, therefore, do not require heavy duty cushioning provided by conventional prior art draft gear assemblies.

More recently, slackless rotary drawbar coupler assemblies have been developed. Such slackless rotary drawbar couplers utilize a gravity wedge to maintain the slackless connection against the spherical or hemispherical drawbar end connection. In view of the fact that such cars making up a unit train are not normally subjected to the high impact forces associated with bumping encountered in classification yards, many of the slackless rotary drawbar couplers have eliminated the use of draft gear assemblies altogether.

In the case of retrofitting existing railroad cars with the newer slackless rotary drawbar couplers, however, it has been found that it is not normally possible to eliminate the draft gear assembly normally positioned in the draft gear pocket of a standard coupler without completely reconstructing the center sill member to eliminate the draft gear pocket. Accordingly, in retrofitting existing railway cars with the newer slackless drawbar couplers, the common practice has been to either utilize conventional draft gear, or fill the draft gear pocket with a solid structure fabricated of steel plate stock to absorb whatever impact forces are created without utilizing moving compressible members. Such fabricated structures, are commonly referred to as a blockout draft gear. These blockout draft gear are, nevertheless, subjected to rather high impact loading when the load changes from draft to buff loading, or vice versa, and have, therefore, always been very heavy structures. Such structures being fabricated of heavy plate steel members in a variety of complex configurations as essential to absorb the loads encountered. While such fabricated blockout draft gear may be more simplified in structure than conventional draft gear with compressible members, prior art blockout draft gear are still rather complicated in structure. For example, such blockout draft gear will often require that the receiving pocket be modified to facilitate their use. One common prior art blockout device for a draft gear pocket is a form fabricated from a section of heavy seamless steel pipe, normally having a wall thickness of more than one inch, welded between a pair of heavy steel end plates, and having a plurality of elongated heavy steel ribs welded to, and spaced around the periphery of the pipe section. Such prior art blockout device for draft gear assembly pockets are time consuming and rather costly to produce.

SUMMARY OF THE INVENTION

The present invention provides a new and improved castable blockout device for a draft gear pocket. This castable blockout device is predicated on the conception and development of a cast one piece structure. Such cast structure generally can be sized to fit within any desired draft gear pocket without modification of such draft gear pocket and without the need for any separate associated components being welded or otherwise joined thereto. The structural configuration of the single piece cast structure is exceptionally strong and rigid and yet simple, making it a form that is relatively easy to cast with simple and conventional foundry techniques. The invented blockout device can be inserted and withdrawn from a draft gear pocket with relative ease. While the use of such a draft gear blockout device will not normally reduce any lateral forces, the invented structure is rigid enough that the lateral forces will not be damaging thereto during normal operation on a railway car.

OBJECTS OF THE INVENTION

It is, therefore, one of the primary objects of the present invention to provide a blockout device for a draft gear pocket on a railway car which can withstand in train forces of greater than one million pounds.

Another object of the present invention is to provide a blockout device for a draft gear pocket which can be cast as a single piece unit.

Still another object of the present invention is to provide a blockout device for a draft gear pocket which does not require any welding.

Yet another object of the present invention is to provide a blockout device for a draft gear pocket which can be produced in a variety of lengths.

A still further object of the present invention is to provide a blockout device for a draft gear pocket which can be used in retrofitting existing railway cars with a slackless drawbar coupling assembly.

An additional object of the present invention is to provide a blockout device for a draft gear pocket which will require essentially no maintenance during its useful life on a railway car.

Another object of the present invention is to provide a blockout device for a draft gear pocket which is relatively light weight.

Still yet another object of the present invention is to provide a blockout device for a draft gear pocket which is relatively inexpensive to manufacture.

Yet still another object of the present invention is to provide a blockout device for a draft gear pocket which is simple to install.

A yet further object of the present invention is to provide a blockout device for a draft gear pocket which will be effective in transmitting impact forces encountered during in train service.

In addition to the several objects and advantages of the castable blockout device described above, various other objects and advantages of the present invention will become more readily apparent to those persons who are skilled in the railway coupling art from the following more detailed description of the invention, particularly, when such description is taken in conjunction with the attached drawing figures and with the appended claims.

DETAILED DESCRIPTION OF THE INVENTION

Figure 2:
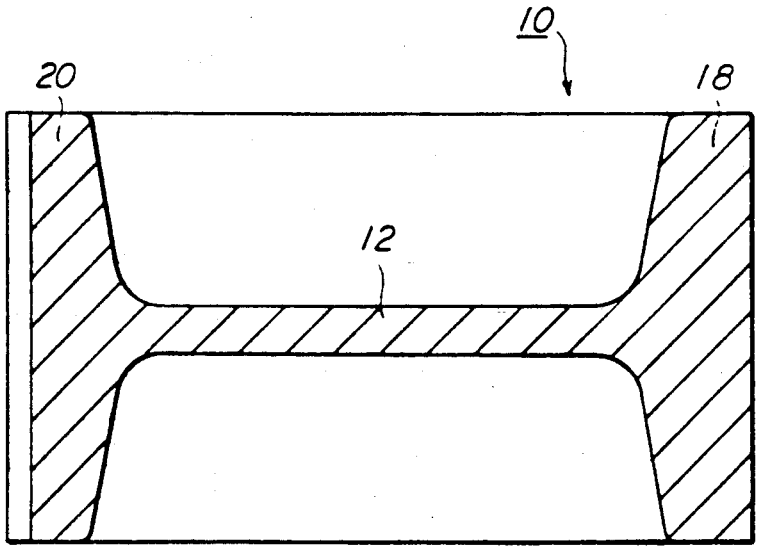
FIG. 2 is a cross-sectional top view of the castable blockout apparatus illustrated in FIG. 1 and taken along the section line II—II of such FIG. 1.

Prior to proceeding to the more detailed description of the present invention, it should be noted that, for the sake of clarity, identical components having identical functions, have been identified with identical reference numerals throughout the several views illustrated in the drawings.

Figure 1:
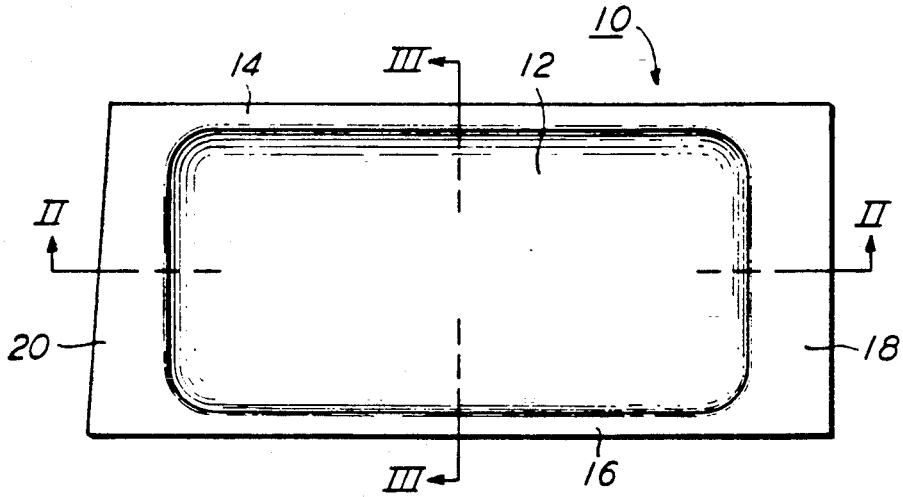
FIG. 1 is a side elevation view of a castable blockout apparatus for a draft gear pocket manufactured according to one presently preferred embodiment of the invention.
Figure 3:
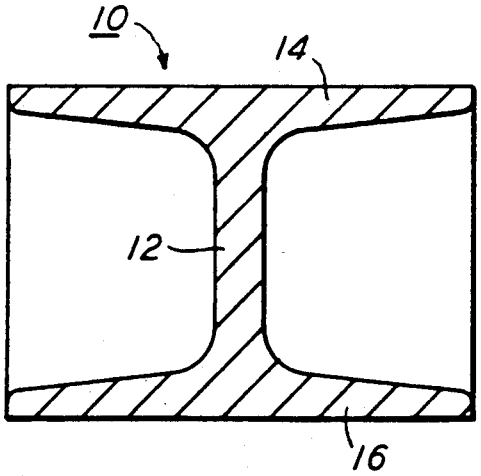
FIG. 3 is a cross-sectional end view of the castable blockout apparatus illustrated in FIGS. 1 and 2, with the section being taken along the line III—III of FIG. 1.
Figure 7:
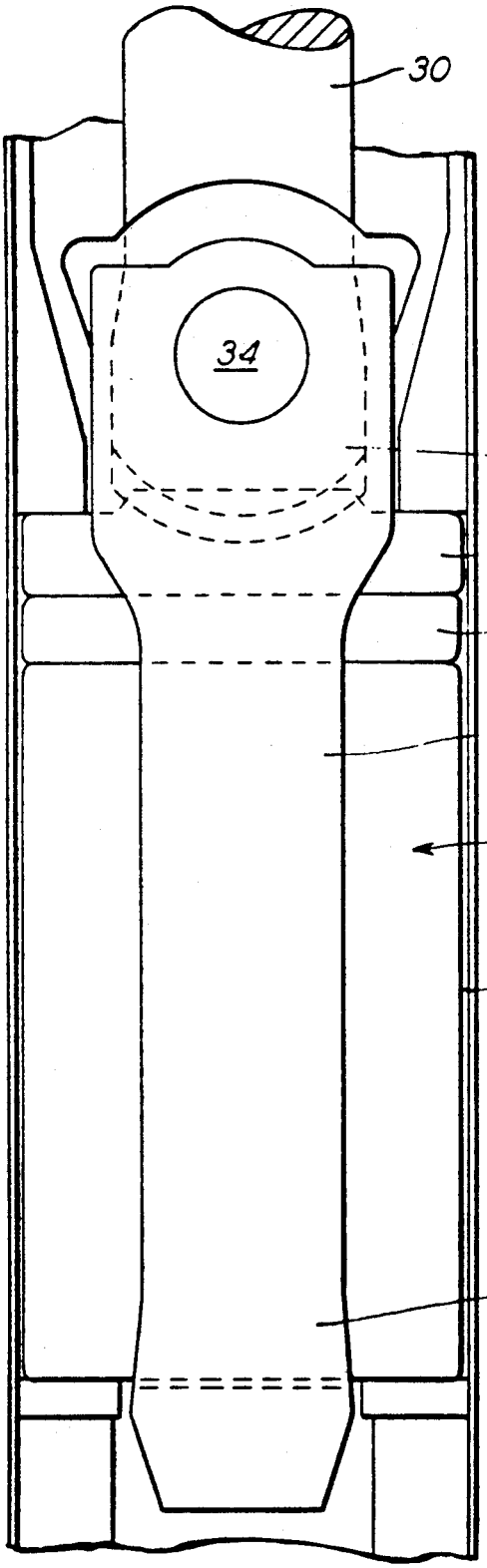
FIG. 7 is a top view of a conventional slackless drawbar connection with the center sill top wall removed to show the castable blockout apparatus illustrated in FIGS. 4–6 in normal operating position within the draft gear pocket.
Figure 8:
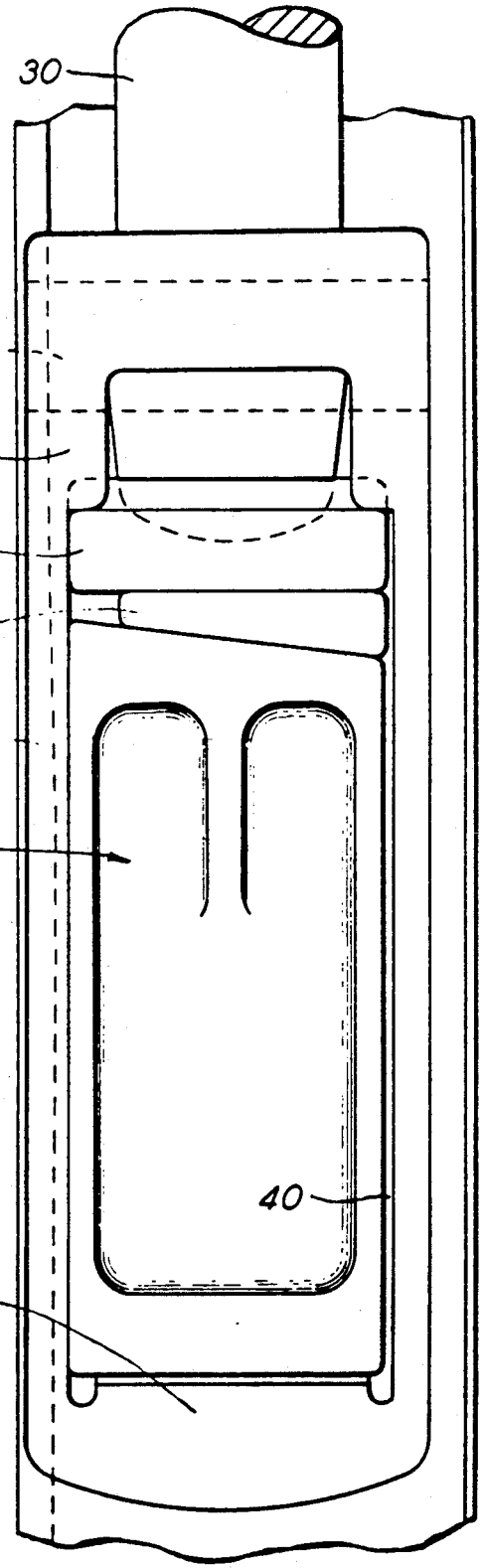
FIG. 8 is side elevation view of the connection shown in FIG. 7 with the side wall of the center sill removed.

Reference to FIGS. 1–3 will illustrate one embodiment of the castable blockout apparatus for a draft gear pocket manufactured according to this invention. In essence, this blockout apparatus comprises a one-piece metallic casting, generally designated 10. Preferably, such blockout apparatus 10 is a steel casting meeting AAR Specification M-211, Grade "E". As can be seen in FIGS. 2 and 3, casting 10 has a mid-length, vertical cross-section similar to that of a wide-flange beam comprising a vertical web 12, with top and bottom flanges 14 and 16. In addition, end flanges 18 and 20 are provided at the ends of vertical web 12 and which extend between the two ends of top and bottom flanges 14 and 16. Accordingly, both the vertical and horizontal cross-section through the mid-point of the castable blockout apparatus 10 are characteristic of a wide-flange beam. The ends of top and bottom flanges 14 and 16, respectively, and end flanges 18 and 20 are joined to form substantially 90 degree intersecting corners which define a box-like periphery of the blockout apparatus 10, forming the top, bottom and two end surfaces, as though a single, four-sided flange extends around the four edges of vertical web 12. Conversely, the two side surfaces of the blockout apparatus 10 perpendicular to the four flanges, are characterized by generally rectangular recesses extending into the sides of such blockout apparatus 10 to the vertical web 12. As shown in FIG. 1, end flange 20 can optionally be provided with an outer surface which is inclined to a vertical plane. This may be necessary to accommodate abutment of such outer surface against a gravity wedge 42 (FIGS. 7 and 8). A gravity wedge 42 is utilized in most of the slackless drawbar couplings presently being used in the railroad industry. For purposes of optimizing the strength and minimizing stress risers, all intersections between the vertical web 12 and top and bottom flanges 14 and 16 and end flanges 18 and 20 and between abutting flanges at the corners of the blockout apparatus 10, are suitably rounded to eliminate reentrant angles. Likewise, the outer corner edges of top and bottom flanges 14 and 16 and end flanges 18 and 20 are rounded to optimize strength and facilitate handling.

Figure 5:
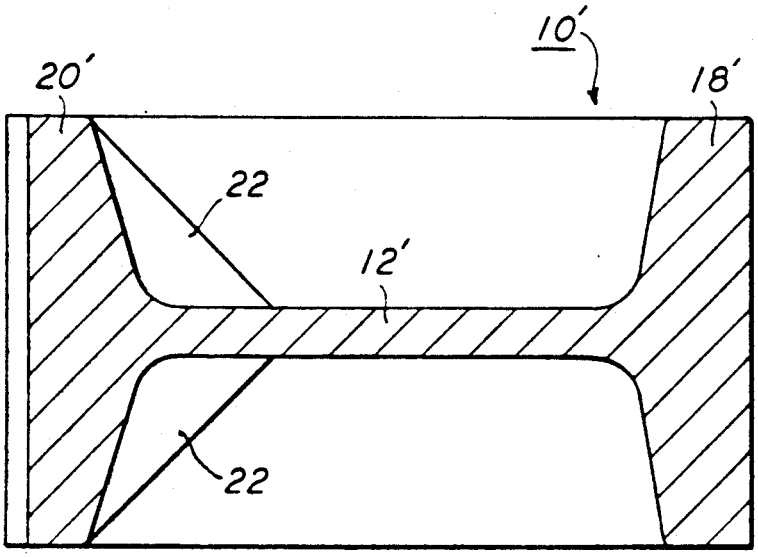
FIG. 5 is a cross-sectional top view of the castable blockout apparatus illustrated in FIG. 4 with the section being taken along the line V—V of FIG. 4.
Figure 4:
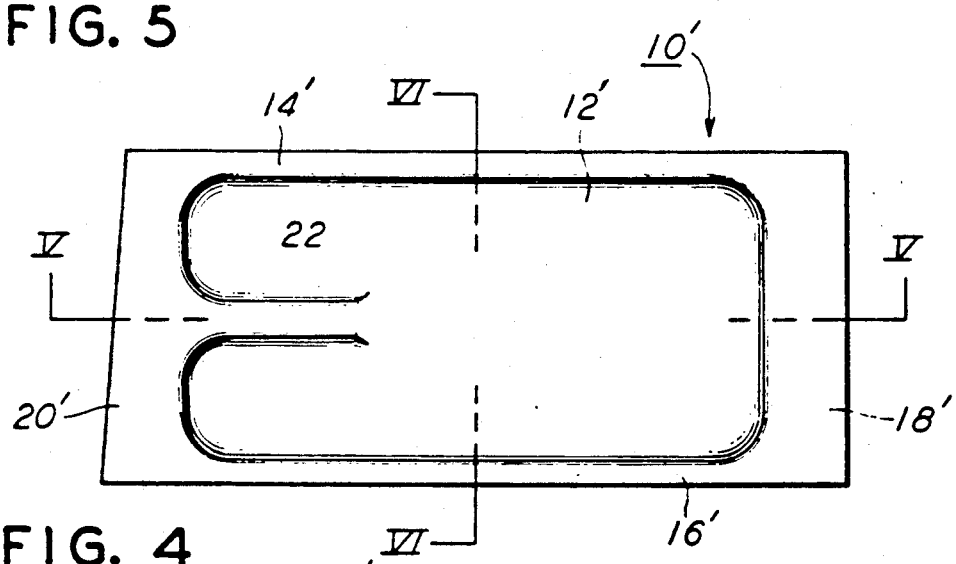
FIG. 4 is a side elevation view of a castable blockout apparatus for a draft gear pocket manufactured according to an alternative embodiment of the present invention.
Figure 6:
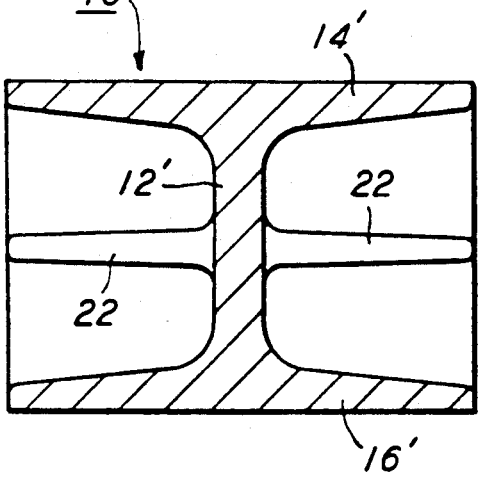
FIG. 6 is an end view of the castable blockout apparatus illustrated in FIGS. 4 and 5 with the section being taken along the line VI—VI of FIG. 4.

Reference to FIGS. 4–6 will illustrate an alternative embodiment of this invention which is substantially the same as that described above except that additional supports 22 are provided to support the mid-sections of end flanges 20',mid-way between the supports provided by top and bottom flanges 14' and 16'. Specifically, the back of each side of end flange 20' is provided with a triangular support 22 which brace the back side of end flange 20' against web 12. Accordingly, the back-side or the base support for end flange 20',comprises web 12' and triangular extensions 22, which present a cruciform configuration abutting against flange 20'.

In view of the above disclosure regarding the extra supports 22 provided for flange 20',it will become apparent that similar triangular supports could be provided to add support for flange 18', or that full length supports could be provided spanning between end flanges 18' and 20' so that the web would have a full length cruciform cross-section. While such structures are contemplated to be within the scope of this invention, such a configuration would be significantly more difficult to cast, and the extra strength provided has been found to be unnecessary.

While the dimensions of any particular castable blockout apparatus 10 for a draft gear pocket, as described above, will vary depending on the particular draft gear pocket within which it will be utilized, it is presently preferred that the dimension be only slightly undersized but sufficient to permit the cast structure to be easily inserted within the draft gear pocket without difficulty. To the extent necessary, shims can be provided between end flange 18 or 18' and the end of the draft gear pocket to prevent any slack that may be present.

Reference to FIGS. 7 and 8 will illustrate the castable blockout apparatus 10 shown in FIGS. 4–6 properly positioned within a draft gear pocket adjacent to a slackless drawbar connection. As shown in FIGS. 7 and 8, a drawbar 30 is connected to a yoke 32 via a coupler pin 34. The forward end of drawbar 30 has a partial convex hemispherical form abutting against follower 36 having a partial, hemispherical concave depression (not visible) in a mating relationship to the hemispherical end of drawbar 30. The blockout apparatus 10' is shown within draft gear pocket 40, such that end flange 20' is spaced from follower 36 by gravity wedge 42. Accordingly, blockout apparatus 10 fills the void between gravity wedge 42 and the base of yoke 32. Accordingly, buff loading forces will bias drawbar 30 against follower 36, gravity wedge 42 and flange 20' of the blockout apparatus 10. Conversely, draft loading forces will bias the inside base of yoke 32 against flange 18'. Gravity wedge 42 functions to space follower 36 from flange 20' keeping the three components tightly fitted within the draft gear pocket without slack; i.e., tightly fitted between the end of drawbar 30 and the inside base of yoke 32, as is a conventional retrofit arrangement for a slackless drawbar connection.

Figure 10:
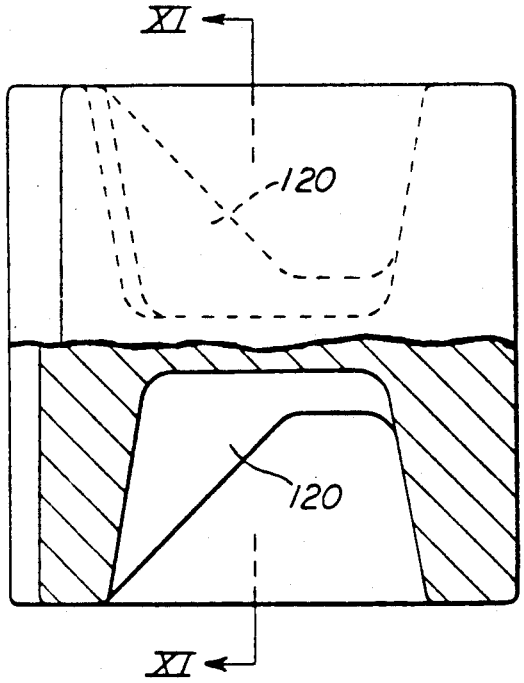
FIG. 10 is a top view partially in cross-section of the castable blockout apparatus illustrated in FIG. 9.
Figure 9:
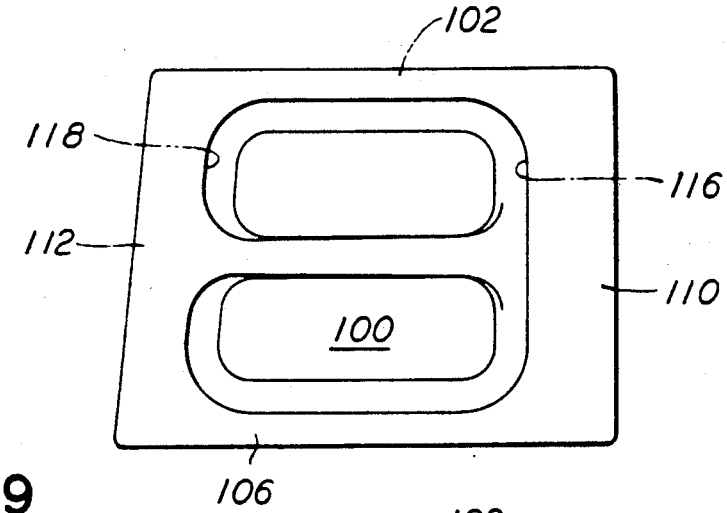
FIG. 9 is a side elevation view of a castable blockout apparatus for a draft gear pocket manufactured according to another presently preferred alternative embodiment of the invention.
Figure 11:
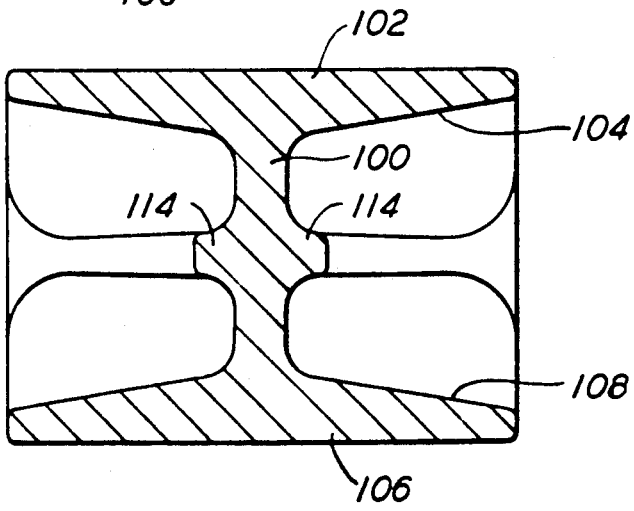
FIG. 11 is a cross-sectional view taken along the lines XI—XI of FIG. 10.

Reference is now made to FIGS. 9–10. Illustrated therein is a castable draft gear pocket blockout apparatus 10 which is positionable within a draft gear pocket located within a center sill member mounted on a railway car body. Such blockout apparatus 10 enables equipping the railway car with a slackless drawbar coupling arrangement discussed above. The blockout apparatus 10 illustrated in FIGS. 9–11 includes a substantially vertically disposed web member 100. Web member 100 has a predetermined height, a predetermined thickness and a predetermined configuration in addition to a predetermined length of an upper outer edge and a predetermined length of a lower outer edge. There is a substantially horizontally disposed top flange member 102 connected substantially along the entire length of a bottom surface 104 thereof and substantially midway between the outer edges thereof to such upper outer edge of the castable member 100. The top flange member 102 has a predetermined thickness and a predetermined width. The length of such bottom surface 104 of top flange member 102 is substantially equal to the length of such upper outer edge of the web member 100.

Blockout apparatus 10 further includes a substantially horizontally disposed bottom flange member 106 connected substantially along an entire length of an upper surface 108 thereof and substantially midway between the outer edges thereof to such lower outer edge of the web member 100. Bottom flange member 106 has a predetermined thickness and a predetermined width and the length of such upper surface 108 of bottom flange member 106 is substantially equal to the length of such lower outer edge of the web member 100.

A first substantially vertically disposed end flange member 110 is connected to each of a first outer edge of the web member 100, the top flange member 102 and the bottom flange member 106 adjacent a first end of such blockout apparatus 10. A second substantially vertically disposed end flange member 112 is connected to each of a second outer end of the web member 100, the top flange member 102 and the bottom flange member 106 adjacent a second end of such blockout apparatus 10. In the presently preferred embodiment, the predetermined length of such upper outer edge of the web member 100 will be less than the predetermined length of such lower outer edge of the web member and such second end flange member 112 will be inclined at a predetermined angle. It is also preferred that the predetermined thickness of each of such top flange member 102 and such bottom flange member 106 will be thinnest adjacent each outer edge thereof and the thickest adjacent a center thereof. It is also preferred that the predetermined thickness of the web member 100 be substantially uniform throughout.

As discussed with reference to FIGS. 1–8, such blockout apparatus will preferably include a pair of substantially horizontally disposed support members 114 extending between a inner surface 116 and 118 of each of the first end flange member 110 and the second end flange member 112 respectively. Support members 114 are connected to laterally opposed surfaces of the web member 100 and substantially midway between such bottom surface of the top flange member 102 and such upper surface of the bottom flange member 106. Preferably, the support members 114 will further include a triangularly shaped portion 120 disposed behind the inner surface of such second end flange member 112. The triangularly shaped portion 120 extends from an outer edge of such second end flange member 112 to a point both of an inner surface of the first end flange member 110.

Although a number of embodiments of the castable draft gear pocket blockout apparatus have been illustrated in the drawings and described in detail above, it should be recognized that various other modifications and adaptations of the invention can be made by those persons who are skilled in the railway coupling art without departing from the spirit and scope of the appended claims.

What is claimed is:

1. A castable draft gear pocket blockout apparatus in a draft gear pocket which is disposed within a center sill member mounted on a railway car body, said blockout apparatus comprising:

(a) a substantially vertically disposed web member having each of a predetermined height, a predetermined thickness, a predetermined configuration, a predetermined length of an upper outer edge and a predetermined length of a lower outer edge;

(b) a substantially horizontally disposed top flange member connected substantially al an entire length of a bottom surface of said top flange members and substantially midway between outer edges of said top flange member to said upper outer edge of said web member, said top flange member having a predetermined thickness and a predetermined width, said length of said bottom surface of said top flange member being substantially equal to said length of said upper outer edge of said web member;

(c) a substantially horizontally disposed bottom flange member connected substantially along an entire length of an upper surface of said bottom flange member and substantially midway between outer edges of said bottom flange member to said lower outer edge of said web member, said bottom flange member having a predetermined thickness and a predetermined width, said length of said upper surface of said bottom flange member being substantially equal to said length of said lower outer edge of said web member;

(d) a first substantially vertically disposed end flange member connected to each of a first outer end of said web member, said top flange member and said bottom flange member adjacent a first end of said blockout apparatus; and vertically disposed end (e) a second substantially flange member connected to each of a second outer end of said web member, said top flange member and said bottom flange member adjacent a second end of said blockout apparatus.

2. A castable draft gear pocket blockout apparatus, according to claim 1, wherein said predetermined length of said upper outer edge of said web member is less than said predetermined length of said lower outer edge of said web member and said second end flange member is inclined at a predetermined angle.

3. A castable draft gear pocket blockout apparatus, according to claim 1, wherein said predetermined thickness of each of said top flange member and said bottom flange member is thinnest adjacent each said outer edges thereof and thickest adjacent a center thereof.

4. A castable draft gear pocket blockout apparatus, according to claim 3, wherein said predetermined thickness of said web member is substantially uniform.

5. A castable draft gear pocket blockout apparatus, according to claim 1, wherein said blockout apparatus further includes a pair of substantially horizontally disposed support members extending between an inner surface of each of said first end flange and said second end flange and connected to radially opposed surfaces of said web member substantially midway between said bottom surface of said top flange member and said upper surface of said bottom flange member.

6. A castable draft gear pocket blockout apparatus, according to claim 5, wherein said support members further include a triangular shaped portion disposed behind said inner surface of said second end flange member.

7. A castable draft gear pocket blockout apparatus, according to claim 6, wherein said triangular shaped portion of said support members extends from an outer edge of said second end flange member to a point short of an inner surface of said first end flange member.

8. A castable draft gear pocket blockout apparatus, according to claim 1, wherein an outer surface of said second end flange member is substantially flat and is engageable with a gravity wedge during service.

9. A castable draft gear pocket blockout apparatus, according to claim 8, wherein radially opposed inner surfaces of said first end flange member and said second end flange member are substantially parallel to each other.

10. A castable draft gear pocket blockout apparatus, according to claim 8, wherein a predetermined thickness of said second end flange member adjacent said top flange member is less than a predetermined thickness of said second end flange member adjacent said bottom flange member.

11. A castable draft gear pocket blockout apparatus, according to claim 1, wherein said castable draft gear pocket blockout apparatus is cast of steel.

12. A castable draft gear pocket blockout apparatus, according to claim 11, wherein said blockout apparatus further includes a radius portion adjacent each intersection of abutting flanges.

13. A castable draft gear pocket blockout apparatus, according to claim 1, wherein an outer surface of said first end flange member is substantially flat.

14. A castable draft gear pocket blockout apparatus, according to claim 2, wherein said predetermined thickness of each of said top flange member and said bottom flange member is thinnest adjacent each said outer edges thereof and thickest adjacent a center thereof and said predetermined thickness of said web member is substantially uniform.

15. A castable draft gear pocket blockout apparatus, according to claim 14, wherein said blockout apparatus further includes a pair of substantially horizontally disposed support members extending between an inner surface of each of said first end flange and said second end flange and connected to radially opposed surfaces of said web member substantially midway between said bottom surface of said top flange member and said upper surface of said bottom flange member and said support members further include a triangular shaped portion disposed behind said inner surface of said second end flange member.

16. A castable draft gear pocket blockout apparatus, according to claim 15, wherein an outer surface of said second end flange member is substantially flat and is engageable with a gravity wedge during service and an outer surface of said first end flange member is substantially flat.

17. A castable draft gear pocket blockout apparatus, according to claim 16, wherein said castable draft gear pocket blockout apparatus is cast of steel.

18. A castable draft gear pocket blockout apparatus, according to claim 17, wherein said blockout apparatus further includes a radius portion adjacent each intersection of abutting flanges.

19. A castable draft gear pocket blockout apparatus, according to claim 18, wherein radially opposed inner surfaces of said first end flange member and said second end flange member are substantially parallel to each other and a predetermined thickness of said second end flange member adjacent said top flange member is less than a predetermined thickness of said second end flange member adjacent said bottom flange member.

20. A castable draft gear pocket blockout apparatus, according to claim 19, wherein an upper surface of said top flange member and a bottom surface of said bottom flange member are substantially flat.

* * * * *

UNITED STATES PATENT AND TRADEMARK OFFICE

CERTIFICATE OF CORRECTION

PATENT NO. : 5,114,027

DATED : May 19, 1992

INVENTOR(S) : Peter Scott Mautino

It is certified that error appears in the above-indentified patent and that said Letters Patent is hereby corrected as shown below:

Column 6, line 61, delete "a" and insert --an--.
Column 7, line 26, delete "al" and insert --along--;
column 7, line 27, delete "members" and insert --member--;
column 7, line 52, after and, delete "vertically disposed end";
column 7, line 53, after substantially, insert --vertically disposed end--.
In the Abstract: line 6, delete "the" third occurance.

Signed and Sealed this

Twenty-second Day of October, 1996

Bruce Lehman

*Attest:*

BRUCE LEHMAN

*Attesting Officer*

*Commissioner of Patents and Trademarks*